US006779551B2

(12) United States Patent
Wiemer et al.

(10) Patent No.: US 6,779,551 B2
(45) Date of Patent: Aug. 24, 2004

(54) WATER-FEED CONFIGURATION FOR HOUSEHOLD APPLIANCES

(75) Inventors: Horst Wiemer, Kleinmachnow (DE); Edwin Bolduan, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 213 days.

(21) Appl. No.: 09/956,155

(22) Filed: Sep. 19, 2001

(65) Prior Publication Data

US 2002/0040941 A1 Apr. 11, 2002

(30) Foreign Application Priority Data

Sep. 19, 2002 (DE) ..... 100 46 347

(51) Int. Cl.[7] ..... F16K 23/00
(52) U.S. Cl. ..... 137/312
(58) Field of Search ..... 137/312, 561 A, 137/599.03, 606, 392, 387; 138/113, 114; 285/13, 123.1, 14, 123.2, 123.3, 124.1, 124.2, 124.4, 45, 131.1; 73/40.5 R, 46

(56) References Cited

U.S. PATENT DOCUMENTS 1,466,592 A * 8/1923 King ..... 285/123.1
1,680,119 A * 8/1928 Schulder ..... 137/606
1,878,097 A * 9/1932 Bletcher et al. ..... 137/606
2,987,076 A * 6/1961 Alderman ..... 137/606
3,397,715 A * 8/1968 Fathauer ..... 137/387
3,765,705 A * 10/1973 Tantam ..... 138/114
3,770,002 A * 11/1973 Brown ..... 137/312
3,874,403 A * 4/1975 Fischer ..... 137/312
4,697,293 A * 10/1987 Knoop ..... 137/387
4,886,305 A * 12/1989 Martin ..... 285/179
4,930,549 A * 6/1990 Renner ..... 137/312
5,156,190 A * 10/1992 Staley, Jr. ..... 137/312
5,449,204 A * 9/1995 Greene et al. ..... 138/113
5,713,387 A * 2/1998 Armenia et al. ..... 137/312
5,918,617 A * 7/1999 Garth ..... 137/312
5,931,184 A * 8/1999 Armenia et al. ..... 137/312
6,003,536 A * 12/1999 Polverari et al. ..... 137/312
6,039,066 A * 3/2000 Selby ..... 137/312
6,305,407 B1 * 10/2001 Selby ..... 137/312
6,446,661 B2 * 9/2002 Armenia et al. ..... 285/123.1
6,546,951 B1 * 4/2003 Armenia et al. ..... 285/123.1

* cited by examiner

*Primary Examiner*—George L. Walton
(74) *Attorney, Agent, or Firm*—Laurence A. Greenberg; Werner H. Stemer; Gregory L. Mayback

(57) ABSTRACT

A water-feed configuration for household appliances includes a hot-water hose 6 and a cold-water hose 8 connected to a single water inlet 32 of the household appliance through a branching section 24.

18 Claims, 2 Drawing Sheets

WATER-FEED CONFIGURATION FOR HOUSEHOLD APPLIANCES

BACKGROUND OF THE INVENTION

Field of the Invention

The invention relates to a water-feed configuration for household appliances.

Possible examples of household appliances that can be fed water through such a water-feed configuration are, in particular, dishwashers, washing machines, coffee machines, tea making machines, other drinks machines, e.g., soup machines, and the like.

A water-feed configuration with a safety hose for the water feed into the top housing region of a household machine, e.g. of a washing machine or of a dishwasher, is disclose in German Patent DE 39 17 013 C2. The safety hose includes a water-channeling pressure hose and a jacket hose that encloses the pressure hose at a radial distance therefrom. A leakage-water channel is formed in the process. The pressure hose is connected to a water faucet through a valve. The jacket hose is connected to a housing that encloses the valve with hermetically sealing action. By virtue of a monitoring configuration in the household machine, the valve is automatically closed when leakage water appears.

The prior art household appliances usually only have one water connection or water inlet, which can be connected to a cold-water-supply line by the water-feed configuration.

In household appliances that require clean water, much of the electrical energy of the appliances is required for heating the cold water.

SUMMARY OF THE INVENTION

It is accordingly an object of the invention to provide a water-feed configuration for household appliances that overcomes the hereinafore-mentioned disadvantages of the heretofore-known devices of this general type and that provides a straightforward and inexpensive possible way of reducing the electrical energy required by household appliances.

With the foregoing and other objects in view, there is provided, in accordance with the invention, a water-feed configuration for a household appliance having a water inlet including a branching section having two water inlets and a single water outlet to be connected to a water inlet of a household appliance, and two water-feed hoses each having an upstream end to be connected to a separate water-supply line and a downstream end connected to a respective one of the two water inlets, the downstream end fluidically connected to the single water outlet through the branching section.

The configuration results, in particular, in the following possibilities and advantages: hot water required by the household appliance can be taken from a hot-water-supply line, of which a household heating system heats the water. Such heating is considerably less expensive than heating up cold water by an electric heating device in the household appliance. As a result, electrical energy is saved. It is, of course, possible for the already hot water to be additionally heated by an electric heating device in the household appliance. The feed configuration of the invention has a straightforward construction and requires only a small number of parts. Thus, it is also inexpensive. A further advantage of the invention is that, rather than requiring two water inlets, one for cold water and one for hot water, the household appliance only requires one water inlet. Further, when use is made of a safety hose, rather than two safety configurations against leakage water being necessary, only a single sensor configuration and a single control configuration for switching off the water feed to the two water-feed hoses in the case of water leakage are necessary.

In accordance with another feature of the invention, the household appliance has a controller, each separate water-supply line has an outlet, a valve configuration is connected between the upstream end of each of the two water-feed hoses and the outlet of each separate water-supply line, and the valve configuration automatically selectively closes and opens a water feed into the upstream ends of the two water-feed hoses dependent upon signals from the controller.

In accordance with a further feature of the invention, the valve configuration includes a first valve and a second valve. The first valve is connected to the upstream end of a first of the two water-feed hoses. The second valve is connected to the upstream end of a second of the two water-feed hoses. The first and second valves are to be controlled by the controller. The first and second valves selectively open and close a respective water feed dependent upon signals from the controller.

In accordance with an added feature of the invention, there is provided a third water-feed hose having an upstream end and a downstream end. The water outlet of the branching section is connected to the upstream end of the third water-feed hose, and the downstream end of the third water-feed hose is connected to the water inlet of the household appliance.

In accordance with an additional feature of the invention, the two water-feed hoses are safety hoses each having a radial inner pressure hose for channeling water and a jacket hose enclosing the pressure hose at a radial distance from the pressure hose to form a leakage-water channel between the jacket hose and the pressure hose.

In accordance with yet another feature of the invention, the two water-feed hoses and the third water-feed hose are safety hoses each having a radial inner pressure hose for channeling water and a jacket hose enclosing the pressure hose at a radial distance from the pressure hose to form a leakage-water channel between the jacket hose and the pressure hose.

In accordance with yet a further feature of the invention, the branching section has a pressure-water channel and a leakage-water channel, the pressure hose of the third water-feed hose is fluidically connected to the pressure hose of the two water-feed hoses through the pressure-water channel of the branching section, and the leakage-water channel of the third water-feed hose is fluidically connected to the leakage-water channels of the two water-feed hoses through the leakage-water channel of the branching section.

In accordance with yet an added feature of the invention, at least one of the two water-feed hoses forms a watertight plug-in connection with the branching section.

In accordance with yet an additional feature of the invention, at least one of the two water-feed hoses forms a watertight plug-in connection with at least one of one of the two water inlets of the branching section.

In accordance with again another feature of the invention, at least one of the two water-feed hoses and the third water-feed hose forms a watertight plug-in connection with the branching section.

In accordance with again a further feature of the invention, the upstream end of a first of the two water-feed hoses is to be connected to a cold-water-supply line and the upstream end of a second of the two water-feed hoses is to be connected to a hot-water-supply line.

In accordance with again an added feature of the invention, the water-feed configuration is for a household washing machine, a dishwasher, a coffee or tea-making machine, and a soup machine.

With the objects of the invention in view, there is also provided a water-feed configuration for connecting a water inlet of a household appliance to cold and hot water supply lines including a branching section having two water inlets, a single water outlet, a pressure-water channel, and a leakage-water channel, two input water-feed safety hoses each having an upstream end to be connected to a separate one of a cold-water-supply line and a hot-water-supply line, a radial inner pressure hose for channeling water from a respective one of the cold-water-supply line and the hot-water-supply line to the pressure-water channel, the radial inner pressure hose fluidically connected to the pressure-water channel, a jacket hose enclosing the pressure hose at a radial distance from the pressure hose to form a hose leakage-water channel between the jacket hose and the pressure hose, the hose leakage-water channel fluidically connected to the leakage-water channel, and a downstream end connected to a respective one of the two water inlets, a third water-feed safety hose having an upstream end connected to the water outlet of the branching section, a radial third inner pressure hose for channeling water, the third inner pressure hose fluidically connected to the pressure-water channel of the branching section, a third jacket hose enclosing the third inner pressure hose at a radial distance from the third inner pressure hose to form a third leakage-water channel between the third jacket hose and the third inner pressure hose, the third leakage-water channel fluidically connected to the leakage-water channel of the branching section, and a downstream end to be connected to a water inlet of a household appliance.

Other features that are considered as characteristic for the invention are set forth in the appended claims.

Although the invention is illustrated and described herein as embodied in a water-feed configuration for household appliances, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
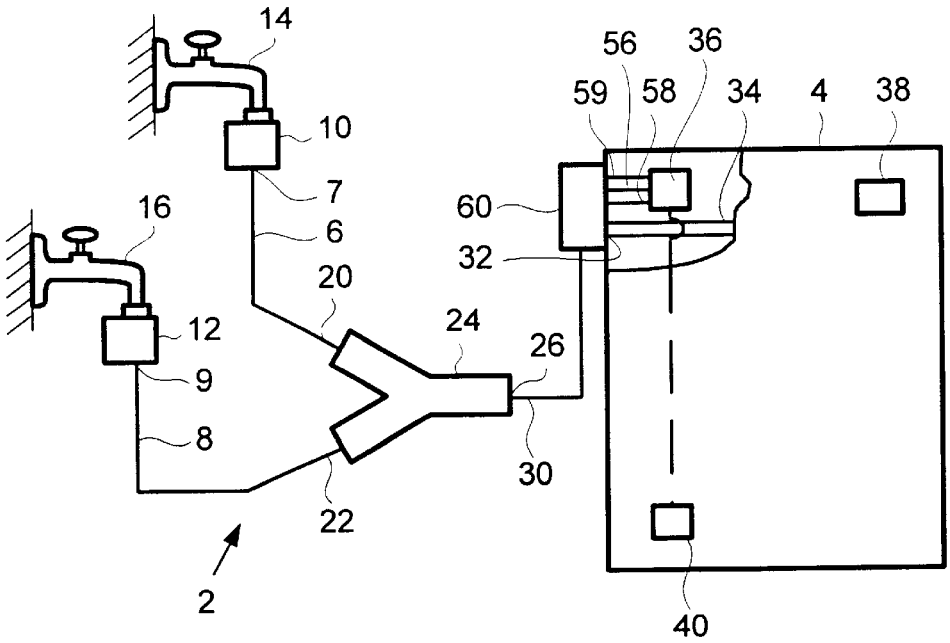
FIG. 1 is a schematic diagram of a water-feed configuration according to the invention.

In all the figures of the drawing, sub-features and integral parts that correspond to one another bear the same reference symbol in each case.

Referring now to the figures of the drawings in detail and first, particularly to FIG. 1 thereof, there is shown a water-feed configuration 2 according to the invention intended for household appliances 4, e.g., a dishwasher or a washing machine. The configuration 2 contains two water-feed hoses 6 and 8, of which one respective end 7, 9 can be screwed, through a respective electrically actuable valve 10, 12, to a respective cold-water faucet 14 of a cold-water-supply line or a hot-water faucet 16 of a hot-water-supply line of a household heating system, or can be fastened thereon in some other way.

The other end 20, 22 of the two water-feed hoses 6 and 8, respectively, is, or can be, connected to a single water outlet 26 through a branching section 24. The water outlet 26 is, or can be, connected in terms of flow to a water inlet 32 of the household appliance 4 either directly or through a third water-feed hose 30.

With the cold-water faucet 14 open or with the hot-water faucet 16 open, the relevant water flows through the water-feed configuration 2 to the water inlet 32 and, from the water inlet 32, into the household appliance 4 through an internal water line 34.

Dependent upon operating conditions in the household appliance 4, e.g., dependent upon washing programs, a control configuration 36 of the household appliance 4, the control configuration 36 preferably being provided with a microcomputer, opens the cold-water valve 10 and/or the hot-water valve 12 or closes either of these two valves. To use the household appliance 4, all that is required is for one of the two water faucets 14 and 16 to be opened and for a desired appliance function to be set using a manual operating element 38 of the household appliance 4.

According to another embodiment, the two valves 10 and 12, rather than being automatically opened and closed dependent upon an operating program or upon the household appliance 4 being switched on and/or off, are normally open at all times and the operator has to open and close the cold-water faucet 14 and/or the hot-water faucet 16 manually for feeding the desired water to the household appliance 4.

According to the preferred embodiment shown in FIG. 1, there is provided at least one leakage-water sensor 40 that, through the control configuration 36—although, according to another embodiment, such procedure can also take place directly without the control configuration 36—closes both valves 10 and 12 whenever it senses leakage water. For such a purpose, the leakage-water sensor 40 is preferably configured in the household appliance 4, preferably, in a water-collecting pan in the vicinity of the appliance base. However, it is also possible for the leakage-water sensor 40 or an additional leakage-water sensor to be configured at some other location, for example, in a leakage-water channel of the water-feed hoses 6, 8, and/or 30 or in the branching section 24 or in the water inlet 32.

The water-feed hoses 6, 8, 30 may be connected to the branching section 24 in a watertight manner—preferably, plugged thereon by way of a plug-in connection formed between them—or may be connected to the branching section 24 in a non-releasable manner, e.g., welded thereon. Alternatively, the water-feed hoses 6, 8, 30 may be integral with the branching section 24.

According to the preferred embodiment, all the water-feed hoses 6, 8, 30 are configured as safety hoses. The hoses 6, 8, 30 preferably have an inner pressure hose 6-1, 8-1, 30-1, respectively, for channeling the water from the supply lines 14 and 16 as well as a jacket hose 6-2, 8-2, 30-2, respectively, that encloses the inner pressure hose 6-1, 8-1, 30-1 on the outside at a radial distance therefrom. A leakage-water channel 6-3, 8-3, 30-3, respectively, is formed therebetween.

For connecting the pressure hoses and the jacket hoses of the three water-feed hoses 6, 8, 30, the branching section 24 preferably has a three-legged pressure-water-channeling star 24-1 made of stiff tubing material or flexible hose material and a jacket star 24-2 that encloses the pressure-water-channeling star 24-1 at a radial distance therefrom on all the radial arms of the star and that is made of hose or tubing material. As a result, a leakage-water-channel star 24-3 is formed between the pressure-water-channeling star 24-1 and the jacket star 24-2. The pressure-water-channeling star 24-1 connects the pressure hoses to one another, the jacket star 14-2 connects the jacket hoses to one another, and the leakage-water-channel star 24-3 of the branching section 24 connects the leakage-water channels of the three water-feed hoses 6, 8, 30 to one another.

The pressure-water-channeling star 24-1 may form plug-in connections or screw-connections with the pressure hoses 6-1, 8-1, 30-1. It is likewise possible for the jacket star 24-2 of the branching section 24 to form a plug-in connection or a screw-connection with the jacket hoses 6-2, 8-2, 30-2.

According to a preferred embodiment, only plug-in connections are provided between the water-feed lines 6, 8, 30 and the branching section 24.

Figure 2:
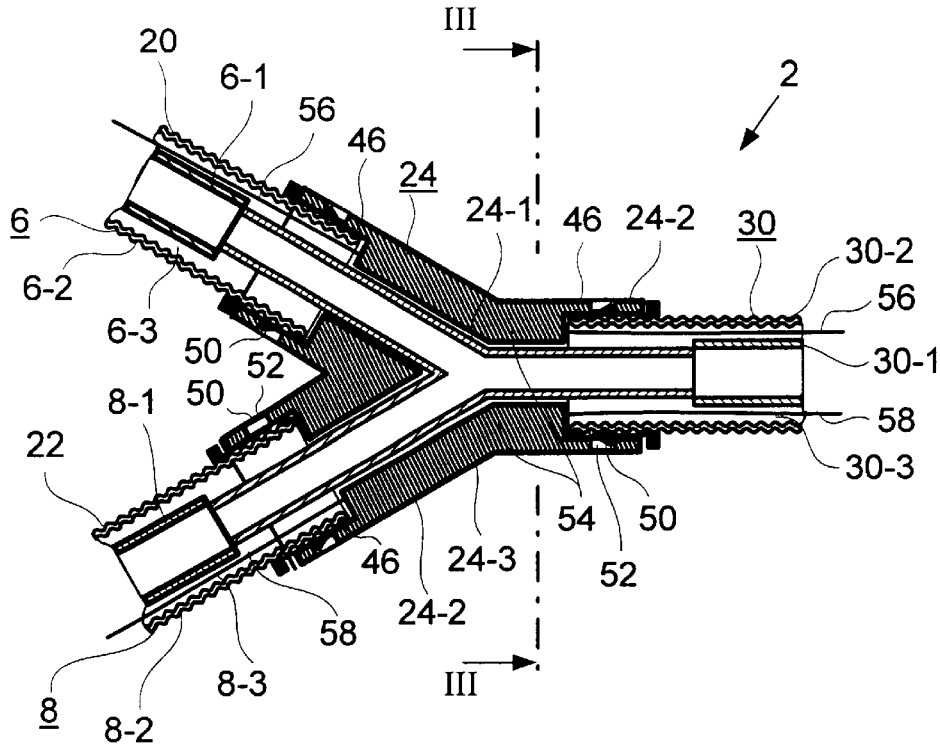
FIG. 2 is a fragmentary, cross-sectional view of a branching section of safety hoses of FIG. 1.
Figure 3:
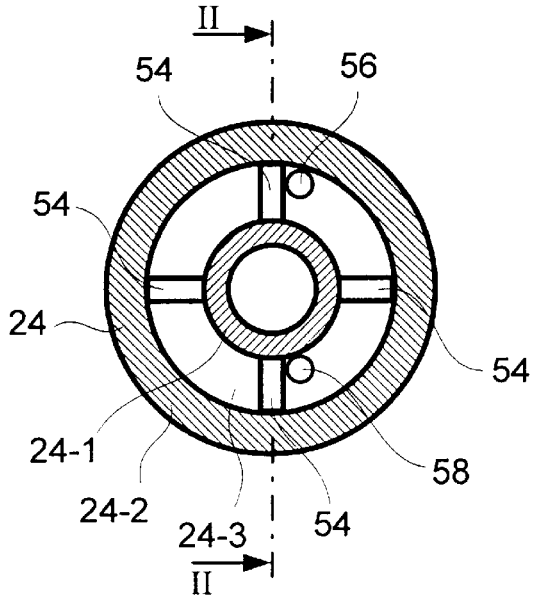
FIG. 3 is a cross-sectional view of a branching section of FIG. 2 along the sectional line III—III.

According to FIG. 2, sealing rings 46 may be provided between the individual plug-together parts. For securing the connection axially, a hook-in device or, according to FIG. 2, a latch-in device may be provided. These devices have, for example, radially resilient catch brackets 50 that are inserted axially in the form of an annular configuration between the jacket hose 6-2, 8-2, 30-2 and the jacket star 24-2 of the branching section 24 and latch in catch openings 52 that are formed in the jacket star 24-2.

Radial crosspieces or ribs 54 may be configured in the branching section 24. The crosspieces or ribs 54 keep the pressure-water-channeling star 24-1 at a radial distance from the jacket star 24-2. Similar crosspieces or ribs 54 may be provided in the water-feed hoses 6, 8, 30 to keep the respective radially inner pressure hose 6-1, 8-1, 30-1 thereof at a radial distance from the respective jacket hose 6-2, 8-2, 30-2 thereof.

Electric lines, e.g., 56, 58, which are necessary for the control of the valves 10, 12 by the control configuration 36 may extend axially through the leakage-water channels 6-3, 8-3, 30-3.

According to a preferred embodiment, the water inlet 32 of the household appliance is provided with a third valve 60, which is opened and closed by the control configuration 36, to interrupt and to feed water from the third water-feed hose 30 dependent upon switching-on and switching-off operations and/or dependent upon operating programs of the household appliance 4 and/or dependent upon the appearance of leakage water. In the preferred embodiment, that end of the third water-feed hose 30 that is remote from the branching section 24 can be connected to the water inlet 32 through the third valve 60.

The invention avoids the situation where the household appliance 4 has to be provided with two separate valves 60 for hot water and cold water.

We claim:

1. A water-feed configuration for a household appliance having a water inlet, comprising:

a branching section having a jacket star, and a pressure-water-channeling star configured at a radial distance from said jacket star;

said pressure-water channeling star including;

two water inlets; and a single water outlet to be connected to a water inlet of a household appliance; and two water-feed hoses each having;

an upstream end to be connected to a separate water-supply line; and a downstream end connected to a respective one of said two water inlets, said downstream end fluidically connected to said single water outlet through said branching section.

2. The water-feed configuration according to claim 1, wherein:

the household appliance has a controller;

each separate water-supply line has an outlet;

a valve configuration is connected between said upstream end of each of said two water-feed hoses and the outlet of each separate water-supply line; and said valve configuration automatically selectively closes and opens a water feed into said upstream ends of said two water-feed hoses dependent upon signals from the controller.

3. The water-feed configuration according to claim 2, wherein:

said valve configuration includes a first valve and a second valve;

said first valve is connected to said upstream end of a first of said two water-feed hoses;

said first valve is to be controlled by the controller;

said second valve is connected to said upstream end of a second of said two water-feed hoses;

said second valve is to be controlled by the controller; and said first and second valves selectively open and close a respective water feed dependent upon signals from the controller.

4. The water-feed configuration according to claim 1, wherein at least one of said two water-feed hoses forms a watertight plug-in connection with said branching section.

5. The water-feed configuration according to claim 1, wherein at least one of said two water-feed hoses forms a watertight plug-in connection with at least one of one of said two water inlets of said branching section.

6. The water-feed configuration according to claim 1, wherein:

said upstream end of a first of said two water-feed hoses is to be connected to a cold-water-supply line; and said upstream end of a second of said two water-feed hoses is to be connected to a hot-water-supply line.

7. The water-feed configuration according to claim 1, further comprising:

radial crosspieces disposed in the branching section for keeping said pressure-water-channeling star at the radial distance from said jacket star.

8. The water-feed configuration according to claim 1, wherein said radial crosspieces are ribs.

9. A water-feed configuration for a household appliance having a water inlet, comprising:

a branching section having:

two water inlets; and a single water outlet to be connected to a water inlet of a household appliance; and two water-feed hoses being safety hoses each having:

a radial inner pressure hose for channeling water;

a jacket hose enclosing said pressure hose at a radial distance from said pressure hose to form a leakage-water channel between said jacket hose and said pressure hose;

an upstream end to be connected to a separate water-supply line; and a downstream end connected to a respective one of said two water inlets, said downstream end fluidically connected to said single water outlet through said branching section; and a third water-feed hose being a safety hose having a radial inner pressure hose for channeling water, a jacket hose enclosing said pressure hose at a radial distance from said pressure hose to form a leakage-water channel between said jacket hose and said pressure hose, an upstream end and a downstream end, said water outlet of said branching section being connected to said upstream end of said third water-feed hose, and said downstream end of said third water-feed hose being connected to the water inlet of the household appliance.

10. The water-feed configuration according to claim 9, wherein:

said branching section has a pressure-water channel and a leakage-water channel;

said pressure hose of said third water-feed hose is fluidically connected to said pressure hose of said two water-feed hoses through said pressure-water channel of said branching section; and said leakage-water channel of said third water-feed hose is fluidically connected to said leakage-water channels of said two water-feed hoses through said leakage-water channel of the branching section.

11. The water-feed configuration according to claim 9, wherein at least one of said two water-feed hoses and said third water-feed hose forms a watertight plug-in connection with said branching section.

12. A water-feed configuration for a household appliance having a water inlet, comprising:

a branching section having:

two water inlets; and a single water outlet to be connected to a water inlet of a household appliance; and two water-feed hoses being safety hoses each having:

a radial inner pressure hose for channeling water;

a jacket hose enclosing said pressure hose at a radial distance from said pressure hose to form a leakage-water channel between said jacket hose and said pressure hose;

an upstream end to be connected to a separate water-supply line, and a downstream end connected to a respective one of said two water inlets, said downstream end fluidically connected to said single water outlet through said branching section.

13. A water-feed configuration for a household appliance having a water inlet, comprising:

a branching section having:

two water inlets; and a single water outlet to be connected to a water inlet of a household appliance; and two water-feed safety hoses each having:

an upstream end to be connected to a separate water-supply line;

a radial inner pressure hose for channeling water from the separate water-supply line;

a jacket hose enclosing said pressure hose at a radial distance from said pressure hose to form a leakage-water channel between said jacket hose and said pressure hose; and a downstream end connected to a respective one of said two water inlets, said downstream end fluidically connected to said single water outlet through said branching section.

14. A water-feed configuration for a household appliance having a water inlet, comprising:

a branching section having;

two water inlets; and a single water outlet;

two water-feed safety hoses each having:

an upstream end to be connected to a separate water-supply line;

a radial inner pressure hose for channeling water from the separate water-supply line;

a jacket hose enclosing said pressure hose at a radial distance from said pressure hose to form a leakage-water channel between said jacket hose and said pressure hose; and a downstream end connected to a respective one of said two water inlets, said downstream end fluidically connected to said single water outlet through said branching section;

a third water-feed safety hose having:

an upstream end;

a radial inner pressure hose for channeling water;

a jacket hose enclosing said pressure hose at a radial distance from said pressure hose of said third water-feed safety hose to form a leakage-water channel between said jacket hose of said third water-feed safety hose and said pressure hose of said third water-feed safety hose; and a downstream end;

said water outlet of said branching section connected to said upstream end of said third water-feed hose; and said downstream end of said third water-teed hose to be connected to a water inlet of a household appliance.

15. A water-feed configuration for a household washing machine having a water inlet, comprising:

a branching section having:

two water inlets; and a single water outlet;

two water-feed safety hoses each having:

an upstream end to be connected to a separate one of a cold-water-supply line and a hot-water-supply line;

a radial inner pressure hose for channeling water from a respective one of said cold-water-supply line and said hot-water-supply line;

a jacket hose enclosing said pressure hose at a radial distance from said pressure hose to form a leakage-water channel between said jacket hose and said pressure hose; and a downstream end connected to a respective one of said two water inlets, said downstream end fluidically connected to said single water outlet through said branching section;

a third water-teed safety hose having:

an upstream end;

a radial inner pressure hose for channeling water;

a jacket hose enclosing said pressure hose at a radial distance from said pressure hose of said third water-feed safety hose to form a leakage-water channel between said jacket hose of said third water-feed safety hose and said pressure hose of said third water-feed safety hose; and a downstream end;

said water outlet of said branching section connected to said upstream end of said third water-feed hose; and said downstream end of said third water-feed hose to be connected to a water inlet of a household washing machine.

16. A water-feed configuration for a household appliance having a water inlet, comprising:

a branching section having;
two water inlets;
a single water outlet;
a pressure-water channel; and
a leakage-water channel;

two water-feed safety hoses each having:
an upstream end to be connected to a separate water-supply line;
a radial inner pressure hose for channeling water from the separate water-supply line;
a jacket hose enclosing said pressure hose at a radial distance from said pressure hose to form a leakage-water channel between said jacket hose and said pressure hose; and
a downstream end connected to a respective one of said two water inlets, said downstream end fluidically connected to said single water outlet through said branching section;

a third water-feed safety hose having:
an upstream end;
a radial inner pressure hose for channeling water;
a jacket hose enclosing said pressure hose at a radial distance from said pressure hose of said third water-feed safety hose to form a leakage-water channel between said jacket hose of said third water-feed safety hose and said pressure hose of said third water-feed safety hose; and
a downstream end;

said water outlet of said branching section connected to said upstream end of said third water-feed hose;

said downstream end of said third water-feed hose to be connected to a water inlet of a household appliance;

said pressure hose of said third water-feed hose fluidically connected to said pressure hose of said two water-feed hoses through said pressure-water channel of said branching section; and said leakage-water channel of said third water-feed hose fluidically connected to said leakage-water channels of said two water-feed hoses through said leakage-water channel of the branching section.

17. The water-feed configuration according to claim 16, wherein:

said upstream end of a first of said two water-feed hoses is to be connected to a cold-water-supply line; and said upstream end of a second of said two water-feed hoses is to be connected to a hot-water-supply line.

18. A water-feed configuration for connecting a water inlet of a household appliance to cold and hot water supply lines, comprising:

a branching section having:
two water inlets;
a single water outlet;
a pressure-water channel; and
a leakage-water channel;

two input water-feed safety hoses each having:
an upstream end to be connected to a separate one of a cold-water-supply line and a hot-water-supply line;
a radial inner pressure hose for channeling water from a respective one of the cold-water-supply line and the hot-water-supply line to the pressure-water channel, said radial inner pressure hose fluidically connected to said pressure-water channel;
a jacket hose enclosing said pressure hose at a radial distance from said pressure hose to form a hose leakage-water channel between said jacket hose and said pressure hose, said hose leakage-water channel fluidically connected to said leakage-water channel; and
a downstream end connected to a respective one of said two water inlets;

a third water-feed safety hose having:
an upstream end connected to said water outlet of said branching section;
a radial third inner pressure hose for channeling water, said third inner pressure hose fluidically connected to said pressure-water channel of said branching section;
a third jacket hose enclosing said third inner pressure hose at a radial distance from said third inner pressure hose to form a third leakage-water channel between said third jacket hose and said third inner pressure hose, said third leakage-water channel fluidically connected to said leakage-water channel of said branching section; and
a downstream end to be connected to a water inlet of a household appliance.

* * * * *